United States Patent [19]

Uhri

[11] Patent Number: 4,830,106

[45] Date of Patent: May 16, 1989

[54] SIMULTANEOUS HYDRAULIC FRACTURING

[75] Inventor: Duane C. Uhri, Grand Prairie, Tex.

[73] Assignee: Mobil Oil Corporation, New York, N.Y.

[21] Appl. No.: 139,238

[22] Filed: Dec. 29, 1987

[51] Int. Cl.[4] ..... E21B 43/26; E21B 49/00

[52] U.S. Cl. ..... 166/250; 166/263; 166/308

[58] Field of Search ..... 166/250, 271, 263, 308

[56] References Cited

U.S. PATENT DOCUMENTS

| | | | |
|---|---|---|---|
| 3,270,816 | 9/1966 | Staadt | 166/308 X |
| 3,329,207 | 7/1969 | Shock et al. | 166/308 X |
| 3,613,785 | 10/1971 | Closmann et al. | 166/308 X |
| 3,822,747 | 7/1974 | Maguire, Jr. | 166/308 X |
| 4,005,750 | 2/1977 | Shuck | 166/308 |
| 4,022,279 | 5/1977 | Driver | 166/308 X |
| 4,223,729 | 9/1980 | Foster | 166/271 |
| 4,683,950 | 8/1987 | Lessi | 166/271 |
| 4,724,905 | 2/1988 | Uhri | 166/308 X |

*Primary Examiner*—George A. Suchfield

*Attorney, Agent, or Firm*—Alexander J. McKillop; Charles J. Speciale; Charles A. Malone

[57] ABSTRACT

A process and apparatus for simultaneous hydraulic fracturing of a hydrocarbonaceous fluid-bearing formation. Fractures are induced in said formation by hydraulically fracturing at least two wellbores simultaneously. While the formation remains pressurized curved fractures propagate from each wellbore forming fracture trajectories contrary to the far-field in-situ stresses. By applying simultaneous hydraulic pressure to both wellbores, at least one curved fracture trajectory will be caused to be transmitted from each wellbore and intersect a natural hydrocarbonaceous fracture contrary to the far-field in-situ stresses.

14 Claims, 6 Drawing Sheets

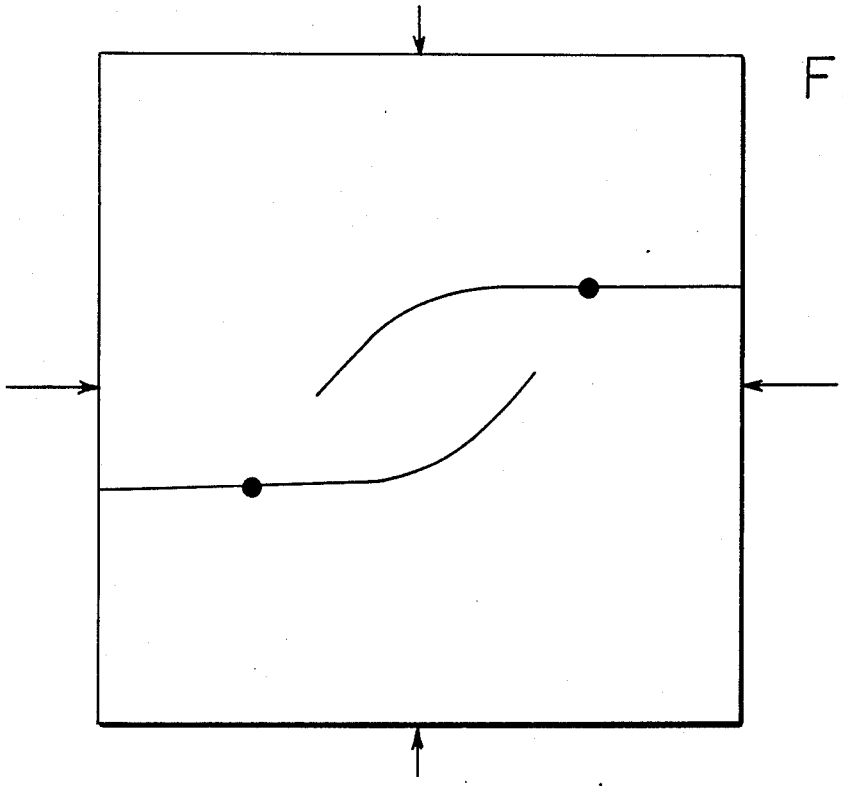
FIG. 4
FIG. 6
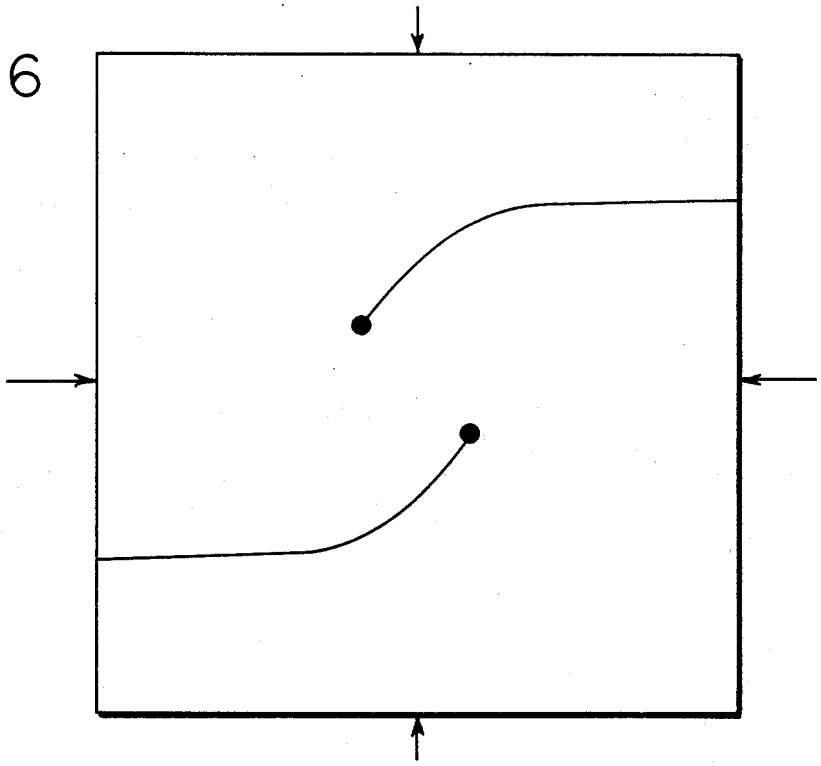

SIMULTANEOUS HYDRAULIC FRACTURING

FIELD OF THE INVENTION

This invention relates to the ability of control the direction of hydraulic fracture propagation in a subsurface formation by hydraulically fracturing the formation in a simultaneous manner. In hydrocarbon-bearing formations, this could significantly increase well productivity and reservoir cumulative recovery, especially in naturally fractured reservoirs.

BACKGROUND OF THE INVENTION

Hydraulic fracturing is well established in the oil industry. In conventional hydraulic fracturing as practiced by industry, the direction of fracture propagation is primarily controlled by the present orientation of the subsurface ("in-situ") stresses. These stresses are usually resolved into a maximum in-situ stress and a minimum in-situ stress. These two stresses are mutually perpendicular (usually in a horizontal plane) and are assumed to be acting uniformly on a subsurface formation at a distance greatly removed from the site of a hydraulic fracturing operation (i.e., these are "far-field" in-situ stresses). The direction that a hydraulic fracture will propagate from a wellbore into a subsurface formation is perpendicular to the least principal in-situ stress.

The direction of naturally occurring fractures, on the other hand, is dictated by the stresses which existed at the time when that fracture system was developed. As in the case of hydraulic fractures, these natural fractures form perpendicular to the least principal in-situ stress. Since most of these natural fractures in a given system are usually affected by the same in-situ stresses, they tend to be parallel to each other. Very often, the orientation of the in-situ stress system that existed when the natural fractures were formed coincides with the present-day in-situ stress system. This presents a problem when conventional hydraulic fracturing is employed.

When the two stress systems have the same orientation, any induced hydraulic fracture will tend to propagate parallel to the natural fractures. This results in only poor communication between the wellbore and the natural fracture system and does not provide for optimum drainage of reservoir hydrocarbons.

Therefore, what is needed is a method whereby the direction of hydraulic fracture propagation can be controlled so as to cut into a natural fracture system and link it to the wellbore in order to increase hydrocarbon productivity and cumulative recovery. This means that the in-situ stress field has to be altered locally in an appropriate manner.

SUMMARY OF THE INVENTION

This invention is directed to a method for the simultaneous hydraulic fracturing of a hydrocarbon-bearing formation penetrated by two closely-spaced wells. In simultaneous hydraulic fracturing, the direction that a hydraulic fracture will propagate is controlled by altering the local in-situ stress distribution in the vicinity of the wellbores. By this method, a hydraulic fracturing operation is conducted simultaneously at two spaced apart wellbores wherein a hydraulic pressure is applied to the formation sufficient to cause hydraulic fractures to form perpendicular to the least principal in-situ stress.

The generated fracture trajectories curve with respect to each other. Depending on the relative position and spacing of the wells in the triaxial stress field and the magnitudes of the applied far-field stresses, the fractures will either curve toward each other or away from each other. In propagating, each fracture then has the potential of intersecting natural fractures thereby significantly improving the potential for enhanced hydrocarbon production and cumulative recovery.

When either fracture intersects at least one hydrocarbon-bearing natural fracture, pressure is released in both hydraulic fractures and hydrocarbons are produced from the formation.

It is therefore an object of this invention to locally alter in-situ stress conditions and control the direction that simultaneous hydraulic fracture will propagate.

It is another object of this invention to locally alter in-situ stress conditions and generate simultaneous hydraulic fractures which will cut into a natural fracture system and connect at least one fracture to the wellbore.

It is yet another object of this invention to increase hydrocarbon production from a subsurface hydrocarbon-bearing formation via simultaneous hydraulic fracturing from at least two wellbores.

It is still yet a further object of this invention to obtain more effective hydraulic fracturing results under different subsurface in-situ stress conditions.

BRIEF DESCRIPTION OF THE DRAWINGS

FIG. 4 schematically illustrates the results of physically modelling the simultaneous hydraulic fracturing of a well-pair in a triaxial stress field.

FIG. 6 depicts schematically simultaneous hydraulic fracturing in a naturally fractured reservoir.

DESCRIPTION OF THE PREFERRED EMBODIMENTS

Figure 1:
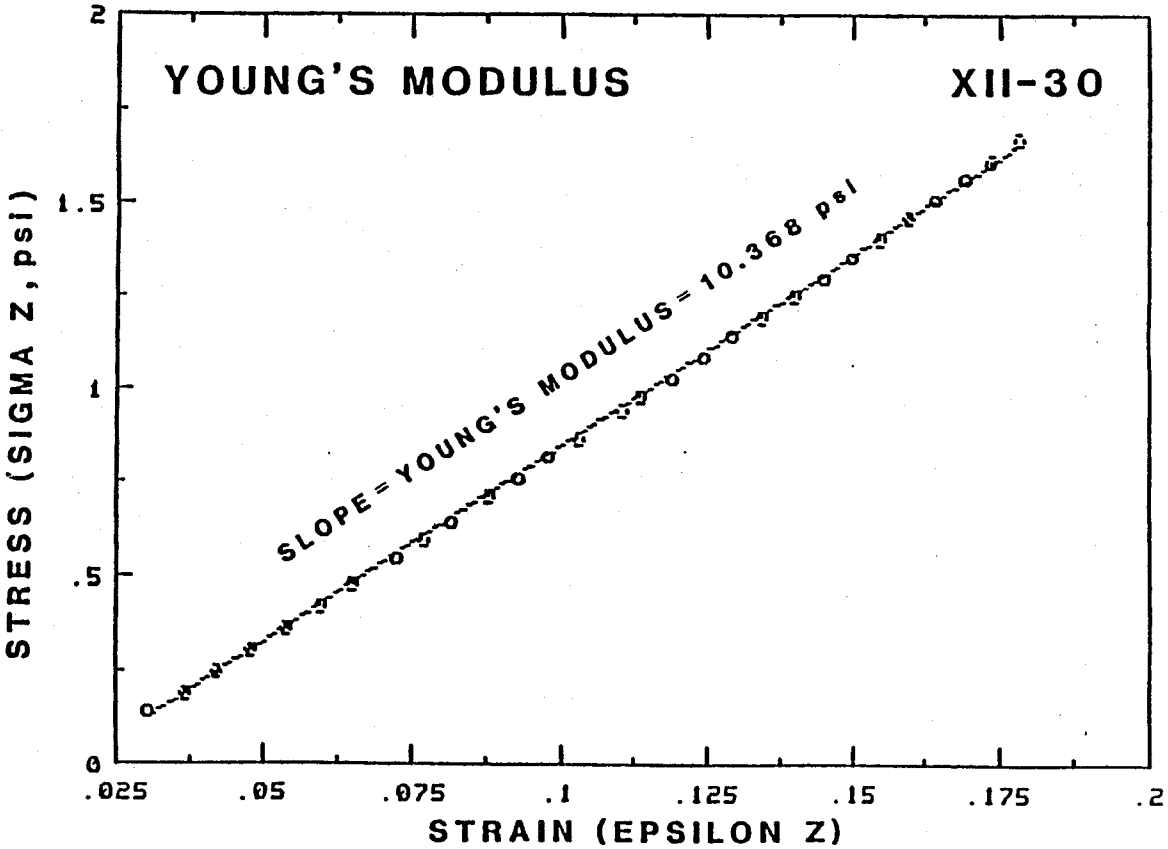
FIG. 1 is a graph of stress versus strain used in the determination of Young's modulus for a polymer specimen.

In the practice of this invention, hydraulic fracturing is initiated at one well in a formation containing two closely-spaced wells. A hydraulic fracturing technique is discussed in U.S. Pat. No. 4,067,389, issued to Savins on Jan. 10, 1978. This patent is hereby incorporated by reference. Another method for initiated hydraulic fracturing is disclosed by Medlin et al. in U.S. Pat. No. 4,378,845 which issued on Apr. 5, 1983. This patent is also incorporated by reference. As is known to those skilled in the art, in order to initiate hydraulic fracturing in the formation, the hydraulic pressure applied must exceed the formation pressures in order to cause a fracture to form. The fracture which forms will generally run perpendicular to the least principal stress in the formation or reservoir.

Natural fractures also form perpendicular to the least principal in-situ stress. However, the natural fracture "trend" is dictated by the geological stresses that were in existence at the time the natural fractures were formed. The orientations of these geological stresses often coincide with the orientations of the present-day subsurface in-situ stresses. In these cases, the result is that a hydraulically induced fracture will tend to assume an orientation that is parallel to that of the natural fracture system.

Factors influencing in-situ stress changes due to hydraulic fracturing are fracture loading, pressure changes, and temperature changes. These factors are discussed in an article entitled "Analysis and Implications of In-Situ Stress Changes During Steam Stimulation of Cold Lake Oil Sands." This article was published by the Society of Petroleum Engineers and was authored by S. K. Wong. This paper was presented at the Rocky Mountain Regional Meeting of the Society of Petroleum Engineers held in Billings, MT, May 19–21, 1986.

This invention utilizes the in-situ stress changes due to simultaneous hydraulic fracturing in at least two spaced apart wells to control the direction of propagation of the propagated fractures in relationship to said spaced apart wells because of the stress forces interacting in the fractured formation. Upon applying a pressure simultaneously in both wells sufficient to hydraulically fracture the reservoir, the hydraulic pressure is maintained on the formation. This pressure causes hydraulic fractures to form substantially perpendicular to the fractures in the natural fracture system. These hydraulic fractures initiate at an angle, often substantially perpendicular, to the natural fracture system and curve away from each well or towards each well depending on the relative position and spacing of the wells in the triaxial stress field and the magnitudes of the applied far-field stresses. Said generated fractures intersect at least one natural hydrocarbon bearing fracture. Thereafter, the pressures are relieved in both wells and hydrocarbon fluids are produced from the intersecting of said natural hydrocarbon bearing fracture.

It has been demonstrated through laboratory experiments that the simultaneous hydraulic fractures do, in fact, curve away from each other. Curving in this manner, said hydraulic fractures intersect at least one natural fracture and connects said fracture to at least one well. Both low-pressure and high-pressure experiments were conducted to verify this simultaneous hydraulic fracturing method. A transparent low-pressure triaxial stress frame was used for hydraulic fracturing studies with polymers as "rock" specimens. A high-pressure polyaxial test cell was used to confirm the low-pressure results in synthetic rock at realistic subsurface in-situ stress conditions.

In order to conduct the low-pressure experiments, it was necessary to develop a modelling medium. The modelling medium selected was Halliburton's "K-Trol" polyacrylamide polymer. Different strengths and properties can be obtained by varying the amounts of monomer and cross-linker that are used in the polymer. "K-Trol" sets up by an exothermic reaction. This polymer can be fractured hydraulically and the more rigid formulations showed photoelastic stress patterns under polarized light. It was further determined that the material was linear elastic (i.e., a plot of stress versus strain in a straight line, as shown in FIG. 1). The polymer showed essentially no stress hysteresis, and behaved in manner similar to rock (e.g., crushes like rock). The main advantages of using this polymer are (a) the material is moldable (in layers when necessary to represent geological model situations); (b) it is transparent so that what is taking place can be observed as it happens; (c) pressures necessary for stressing the model are very low (a few psi); (d) large models can be constructed to minimize edge effects and to accommodate multi-well arrays; and (e) media over a broad range of rigidities can be readily formulated.

A polymer block was molded in a substantially well-oiled Plexiglas® mold with an oil layer floated on top of the polymerizing fluid. The polymer block was formed in three layers. The layer to be hydraulically fractured was usually about 2 inches thick and sandwiched between two ¼ inch layers of a less rigid polymer composition. The reason for this was to contain the fracture within the thicker layer and prevent the fracturing fluid from escaping elsewhere in the model system.

Each polymer layer required approximately 1 to 2 hours to set up sufficiently before another layer could be added. Additional layers were poured directly through the protective oil layer and became bonded to the underlying layer upon polymerizing. The time required for full-strength polymerization is about 24 hours.

Figure 2:
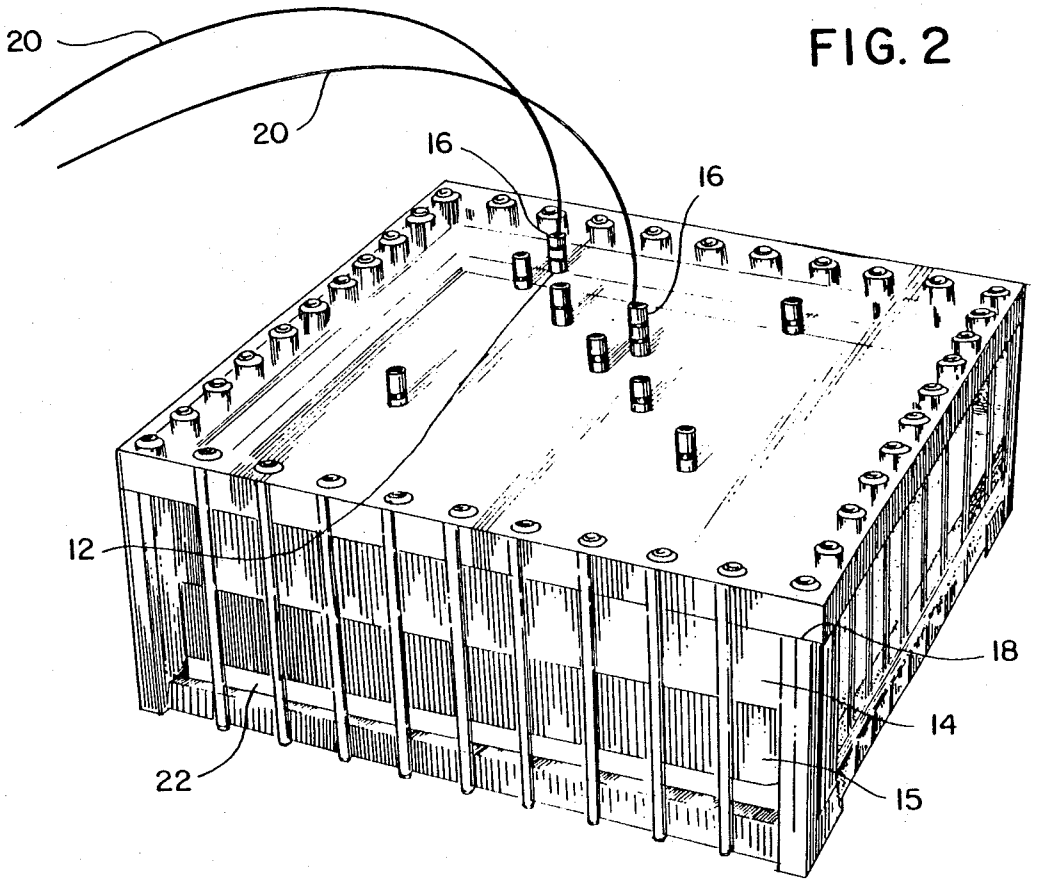
FIG. 2 is a perspective view of a low-pressure triaxial stress frame wherein a polymer block is deployed.
Figure 2A:
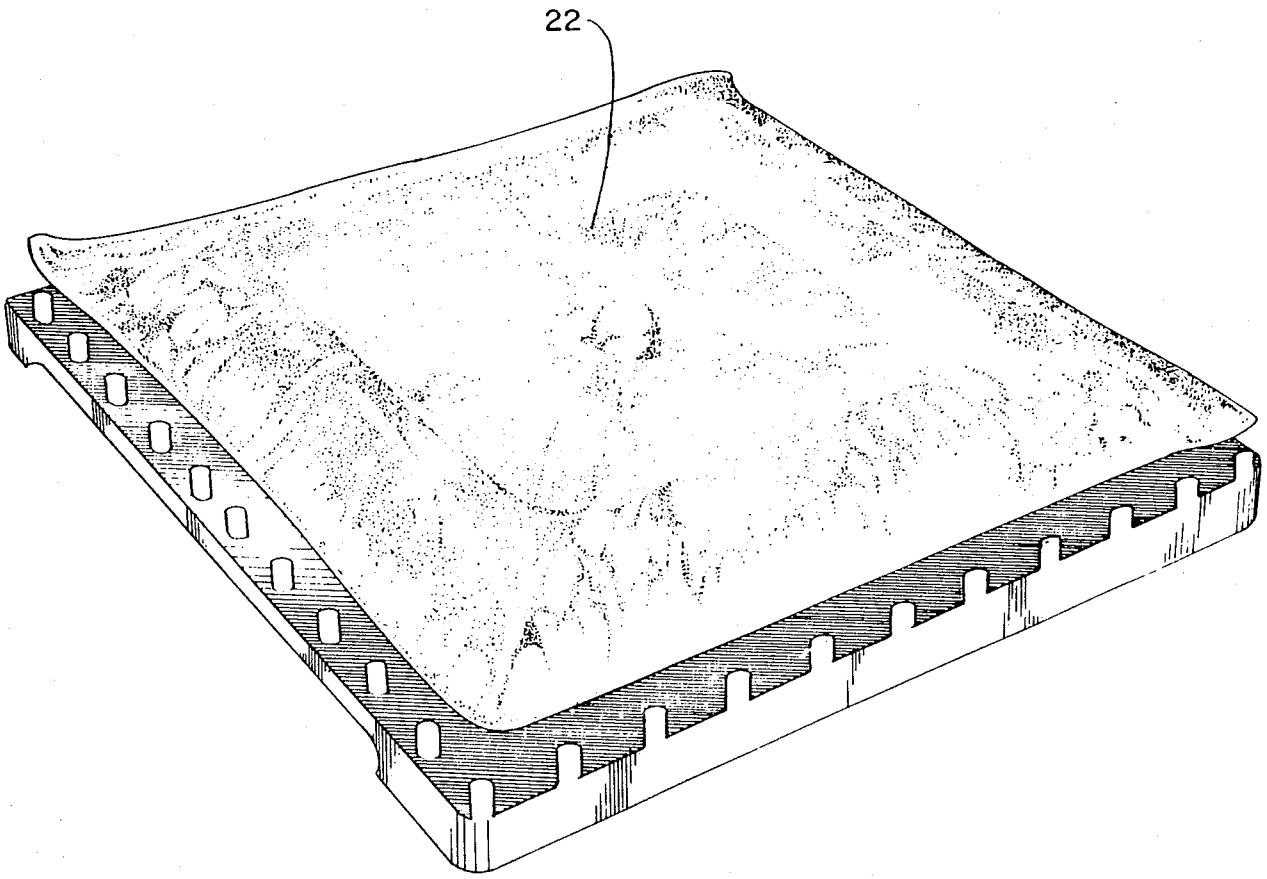
FIG. 2A is a perspective view of the pressurized bladder which rests in the bottom of the triaxial stress frame wherein the polymer block is deployed.

A Plexiglas stress frame as shown in FIGS. 2 and 2A was used to stress the polymer block triaxially (i.e., three mutually perpendicular stresses of different magnitudes). This frame has internal dimensions of about 14×14×5 inches and is constructed of 1 inch thick Plexiglas of substantially good optical quality.

The polymer test block was stressed in the following manner. First, the test block was molded so that its dimensions were less then those of the stress frame. The dimensions of the test block are dictated by the Young's modulus of the polymer formulation being stressed and the desired magnitudes of the boundary stresses. A representation of the determination of Young's modulus from a plot of stress versus strain is depicted in FIG. 1. When the stress frame is loaded uniaxially, triaxial stresses are obtained due to deformation of the polymer block and its interaction with the walls of the stress frame. As a load is applied to one set of faces of the polymer block, the block will begin to deform. At some point, a second set of faces will come into contact with the walls of the stress frame and start building up pressure against these walls. Later, after further deformation, the third set of faces will touch the remaining walls and start building up pressure there. The result is triaxial stress obtained from uniaxial loading.

In this stress frame, the load is applied by means of a pressurized bladder 22 as shown in FIGS. 2 and 2A. Both water and air are used to pressure up the bladder. This bladder is made of 8 mil vinyl that was cut and heat sealed into form. A Plexiglas plate 15 above the bladder transmits the load (usually less than 2 psi) to the polymer block 14.

To determine the magnitudes and/or ratios of the stresses obtained following this procedure, a theory for finite stress-strain relationships was developed. Widely published conventional infinitesimal stress-strain relationships were found not to be valid since the strains observed were by no means infinitesimal. A computer program was written to calculate what the dimensions of the polymer block should be so as to provide specified triaxial stress ratios when loaded uniaxially. The theory and the computer program provide for the finite stress-strain relationships for an incompressible linear elastic deformable homogeneous isotropic medium.

Oil is the principal fracturing fluid utilized. Oil was selected because it does not penetrate into the polymer block and is easily dyed with the oil-based dye "Oil Red-O".

The fracturing fluid is injected into the polymer block via "wellbores" 12 through the top 18 of the triaxial stress frame in Figure 2. These "wellbores" are lengths of stainless steel hypodermic tubing that are set in place after the polymer block 14 is stressed. They are secured in position with Swage-lock fittings 16 mounted in the top of the stress frame as shown in FIG. 2. Plastic tubing 20 connects these fittings to small laboratory peristaltic pumps (not shown) which provide the fracturing fluid pressures.

Experiments were conducted in this transparent triaxial test cell to simulate hydraulic fracturing in a natural formation. Both non-interacting hydraulic fractures and simultaneous hydraulic fractures were generated. Non-interacting hydraulic fracturing is defined to mean the process of creating a fracture and releasing the pressure in the fracture prior to the initiation of a subsequent fracture as is common practice to those skilled in the art. Simultaneous hydraulic fracturing is defined to means the technique whereby hydraulic fracturing is initiated in two spaced apart wellbores. Said wellbores have placed therein a simultaneous hydraulic pressure sufficient to create at each well hydraulic fractures which propagate simultaneously and curve with respect to each other. These fractures can curve toward each other or away from each other depending on the relative position and spacing of the wells in the triaxial stress field and the magnitudes of the applied far-field stresses.

In order to predict and/or explain hydraulic fracturing behavior associated with these experiments, a theory for simultaneous hydraulic fracturing was developed. This theory is based on the superposition of work by M. Greenspan, "Effect of a Small Hole on the Stresses in a Uniformly Loaded Plate," Quarterly Appl. Math., Vol. 2 (1944) 60–71; and by I. N. Sneddon and H. A. Elliott, "The Opening of a Griffith Crack Under Internal Pressure," Quarterly Appl. Mat., Vol. 3 (1945) 262–267.

Figure 3:
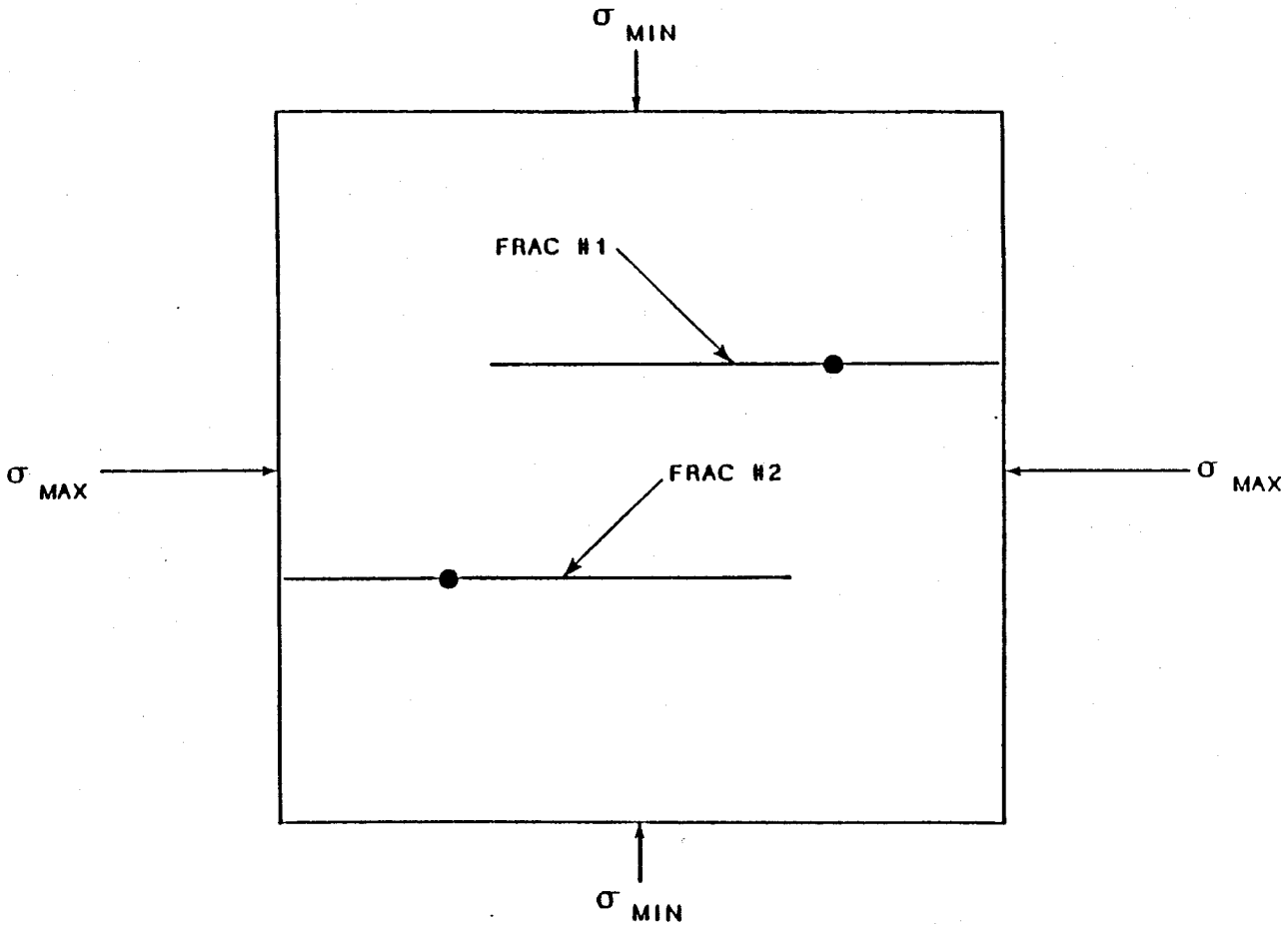
FIG. 3 is a schematic diagram resultant from physically modelling the generation of two non-interacting hydraulic fractures in triaxial stress field.

Experimental results for fracturing response in the case of non-interacting hydraulic fractures were evaluated. It was demonstrated that, in the absence of local alterations in the in-situ stress field, hydraulic fractures are controlled by the "far-field" in-situ stresses. According to theory, all non-interacting hydraulic fractures should be parallel to each other and perpendicular to the least principal in-situ stress. FIG. 3 depicts two wells that have been hydraulically fractured under conditions of non-interaction of the hydraulic fractures as in the case of conventional hydraulic fracturing. The far-field stresses $\sigma_{max}$ and $\sigma_{min}$ represent the maximum and minimum principal horizontal stresses respectively. This same type of phenomenon was observed in the physical modelling experiments using the transparent polymer in the low-pressure stress frame and demonstrates that the triaxial stress frame performs as predicted.

FIG. 4 illustrates the results of simultaneous hydraulic fracturing. This illustration shows the results obtained when hydraulic pressure is applied to two spaced apart wellbores based upon reasonably expected results. As is illustrated, it was expected that the fractures propagated from each well would curve toward each other because of the simultaneous alteration of the local in-situ stress field.

Figure 5:
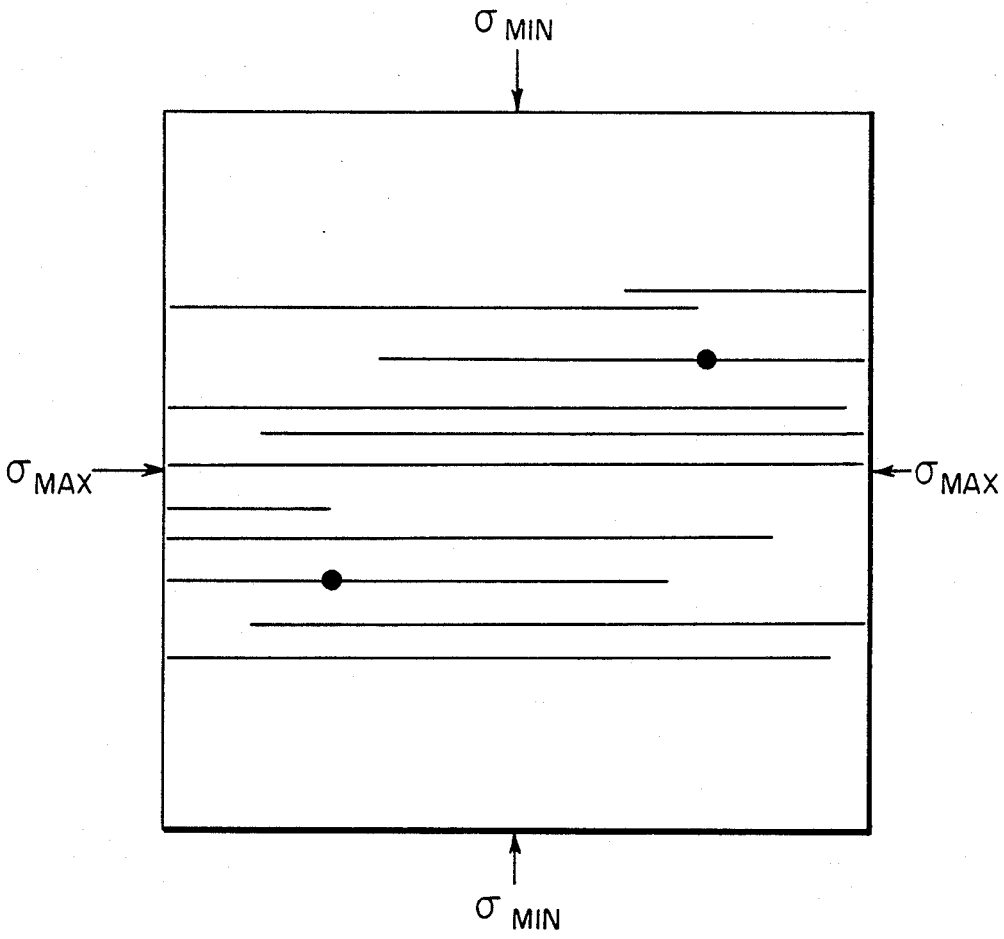
FIG. 5 illustrates schematically a conventional non-interacting hydraulic fracturing in a naturally fractured reservoir.

FIG. 5 illustrates conventional non-interacting hydraulic fracturing in a naturally fractured reservoir. In this case, the hydraulic fractures are parallel to the natural fractures.

FIG. 6 depicts schematically what was observed in the triaxial stress frame when simultaneous hydraulic fracturing was simulated. The shorter arrows in FIG. 6 indicate where minimum far-field stress was applied to the polymer specimen. Maximum simulated far-field stress is represented by the longer arrow. Upon application of simultaneous hydraulic pressure through the wellbores with the stress frame loaded, the propagated fractures initially were directed toward the stress frame boundary having the minimum simulated far-field stress. These initiated fractures curved away from the simulated wellbores. By utilizing these observations, predictions can be made regarding the necessary factors needed to apply simultaneous hydraulic fracturing so as to intersect a hydrocarbonaceous bearing fracture in a natural environment. As previously mentioned, factors influencing in-situ stress changes due to hydraulic fracturing are fracture loading, pressure changes, and temperature changes.

From the preceding experiments and theoretical analysis, it is shown that the proper design and interpretation of physical modelling studies would enable the industry to not only save on expenditures associated with fracturing treatments, but also to actually create significant additional sources of revenue. As much as a million gallons of expensive fracturing fluid is used in some treatments. Poorly designed fracture treatments may result in fractures which stray into unproductive formations, thereby wasting the fracturing fluid or watering-out the well.

In the foregoing, it has been demonstrated that fracture propagation directed can be altered. By hydraulically fracturing paired-wells simultaneously, fractures can be made to grow in a direction contrary to what would be expected under natural in-situ stress conditions. In simultaneous hydraulic fracturing, the fractures tend to curve away from the wellbores. As will be apparent to those skilled in the art, these demonstrations have applications to hydraulic fracturing in naturally fractured reservoirs.

Obviously, many other variations and modifications of this invention, as previously set forth, may be made without departing from the spirit and scope of this invention as those skilled in the art will readily understand. Such variations and modifications are considered part of this invention and within the purview and scope of the appended claims.

I claim:

1. a process for the simultaneous hydraulic fracturing of a hydrocarbonaceous fluid-bearing formation comprising:

(a) determining a hydraulic pressure necessary to fractures said formation from at least two wells which penetrate said formation;

(b) injecting a hydraulic fracturing fluid into both wells under the determined hydraulic pressure; and (c) applying simultaneously the determined hydraulic pressure to said hydraulic fluid contained in both wells which pressure is sufficient to fracture said formation thereby causing a fracture to be propagated from each well in a curved manner sufficient to intersect at least one natural hydrocarbonaceous fluid-bearing fracture.

2. The process as recited in claim 1 where steps (a), (b) and (c) are repeated after pressure is removed from said formation.

3. The process as recited in claim 1 where after step (c) hydrocarbonaceous fluids are produced from at least one well after intersecting at least one natural hydrocarbonaceous fluid bearing fracture.

4. A process for predicting the magnitude of forces required to cause fracturing of a subterranean formation whereby utilizing uniaxial stress, a force can be generated sufficient to cause triaxial stress in a model comprising:

(a) placing within a triaxial stress frame, a solid polymer test block whose dimensions are determined by Young's modulus of the polymer being stressed and the desired magnitudes of the boundary stresses;

(b) lying at the bottom of said block, an inflatable bladder separated from said block by a solid sheet of thermoplastic polymer which sheet is sufficient to withstand stresses generated within said frame;

(c) confining said test block, said bladder, and said solid sheet with sheets of a thermoplastic polymer of a strength sufficient to allow stressing of said block by triaxial forces;

(d) directing at least two simulated wellbores through a top thermoplastic sheet and into said test block in a manner sufficient to permit perforations contained in said wellbore to contact said test block;

(e) applying uniaxial stress to said test block which causes triaxial stresses to be exerted through said stress frame in an amount sufficient to simulate stresses expected to be encountered in a subterranean formation;

(f) injecting simultaneously into both wellbores, a liquid under pressure sufficient to fracture said test block while maintaining triaxial stresses and liquid pressure on said test block which causes a curved fracture to propagate from each wellbore; and (g) predicting from the observed fracture patterns of said block the manner by which hydraulic fracture trajectories can be controlled by locally altering an in-situ stress field so as to intersect at least one hydrocarbonaceous bearing fracture.

5. The process as recited in claim 4 where in step (a) said test block comprises a polyacrylamide polymer of about 2 to 4 inches thick.

6. The process as recited in claim 4 where said bladder comprises vinyl of about 8 mil in thickness which is cut and heat sealed to the shape of the frame and is able to withstand a pressure of about 2 psi.

7. The process as recited in claim 4 where in step (b) said solid sheet comprises a poly-(methyl methacrylate) type polymer of about ¼ inch in thickness.

8. The process as recited in claim 4 where the thermoplastic polymer sheet in step (c) comprises a poly-(methyl methacrylate) type polymer of a thickness of about ¼ of an inch.

9. The process as recited in claim 4 where in step (d) said wellbores each comprise a stainless steel hypodermic tubing.

10. The process as recited in claim 4 where in step (d) the liquid comprises a dyed oil.

11. The method as recited in claim 1 where the fracture propagated from each well curves toward the other fracture.

12. The method as recited in claim 1 where the fracture propagated from each well curves away from the other fracture.

13. The process as recited in claim 4 where the fracture propagated from each wellbore curves toward the other fracture.

14. The process as recited in claim 4 where the fracture propagated from each wellbore curves away from the other fracture.

* * * * *